US011292567B2

(12) United States Patent
Fukuchi

(10) Patent No.: US 11,292,567 B2
(45) Date of Patent: Apr. 5, 2022

(54) STEERING LOAD ADJUSTMENT DEVICE FOR OUTBOARD MOTOR

(71) Applicant: SUZUKI MOTOR CORPORATION, Hamamatsu (JP)

(72) Inventor: Satoru Fukuchi, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 0 days.

(21) Appl. No.: 17/024,004

(22) Filed: Sep. 17, 2020

(65) Prior Publication Data

US 2021/0122450 A1 Apr. 29, 2021

(30) Foreign Application Priority Data

Oct. 28, 2019 (JP) ..... JP2019-195140

(51) Int. Cl.
*B63H 20/12* (2006.01)
*B63H 20/10* (2006.01)
*B63H 20/06* (2006.01)

(52) U.S. Cl.
CPC ..... *B63H 20/12* (2013.01); *B63H 20/10* (2013.01); *B63H 20/06* (2013.01)

(58) Field of Classification Search
CPC ..... B63H 20/12; B63H 20/10; B63H 20/06
See application file for complete search history.

(56) References Cited

U.S. PATENT DOCUMENTS 5,582,527 A * 12/1996 Nakamura ..... F02B 61/045 440/55
6,174,211 B1 * 1/2001 Nakamura ..... B63H 20/10 440/55
2021/0122451 A1 * 4/2021 Tejima ..... B63H 20/06

FOREIGN PATENT DOCUMENTS

JP 2000053088 A 2/2000

* cited by examiner

*Primary Examiner* — Stephen P Avila
(74) *Attorney, Agent, or Firm* — Holtz, Holtz & Volek PC

(57) ABSTRACT

A steering load adjustment device for an outboard motor is provided, which stabilizes a steering load of the outboard motor, and obtains good steering performance. In a steering load adjustment device (20) for an outboard motor that is disposed between a steering bracket (15) and a swivel bracket (14), and adjusts a loaded load to a steering operation following steering a steering handle (18), adjustment of the loaded load to the steering operation is performed by a change in frictional force of friction pads (24*b*, 25*b*) contacting a friction plate (22), and a shape of a portion above the swivel bracket, of the friction plate is formed into a U-shape (22*b*, 22*f*) that protrudes toward the outboard motor side as viewed from a lateral side of an outboard motor (1).

4 Claims, 5 Drawing Sheets

STEERING LOAD ADJUSTMENT DEVICE FOR OUTBOARD MOTOR

BACKGROUND OF THE INVENTION

Field of the Invention

The present invention relates to a steering load adjustment device for an outboard motor.

Description of the Related Art

In an outboard motor mounted to a ship, the outboard motor swings around a steering shaft in response to steering to change the traveling direction of the hull. Among the outboard motors in which a ship operator manually operates a steering handle during steering, there is known an outboard motor in which the steering load is made adjustable.

For example, in Japanese Patent Laid-Open No. 2000-53088, a clutch mechanism including an arcuate friction plate and tightening pad portions that sandwich the friction plate from both sides is included, and the tightening pad portions are pressed against the friction plate to increase friction and immobilize the steering bracket to fix the steering angle of the outboard motor.

In the clutch mechanism in Japanese Patent Laid-Open No. 2000-53088, the friction plate having a large spring constant and is difficult to deform is fixed to the swivel bracket with a bolt. Therefore, followability of the friction plate is bad when a steering operator presses the steering handle down and a load is applied from above, and a change easily occurs to the contact state between the tightening pad portions and the friction plate. In particular, when the load from above is large, there is a problem that the phenomenon occurs, in that the tightening pad portions contact the friction plate having a low ability to follow the load, with one-sided contact, and the steering feeling is likely to change.

A large space for disposing related components required for steering is often provided between the swivel bracket that supports an outboard motor so that the outboard motor is capable of performing a tilt operation, and the steering bracket that supports the outboard motor to be capable of performing a steering operation. However, even if the steering-related components are attached, there may be room in the space, and the effective use of the space has been a potential issue.

SUMMARY OF THE INVENTION

The present invention is made in the light of the above points, and provides a steering load adjustment device for an outboard motor that stabilizes a steering load of the outboard motor, and obtains good steering performance.

The present invention is a steering load adjustment device for an outboard motor that is disposed between a steering bracket and a swivel bracket, and adjusts a loaded load to a steering operation following steering of a steering handle, wherein adjustment of the loaded load to the steering operation is performed by a change in frictional force of friction pads contacting a friction plate, and a shape of a portion above the swivel bracket, of the friction plate is formed into a U-shape that protrudes toward the outboard motor side as viewed from a lateral side of the outboard motor.

According to the steering load adjustment device for an outboard motor of the present invention, it is possible to stabilize a steering load of the outboard motor and obtain good steering performance by decreasing a spring constant to make the friction plate easy to deform in the U-shape of the friction plate.

The present disclosure relates to subject matter contained in Japanese Patent Application No. 2019-195140 (filed on Oct. 28, 2019) which is expressly incorporated herein by reference in its entirety.

DETAILED DESCRIPTION OF THE PREFERRED EMBODIMENT

Figure 1:
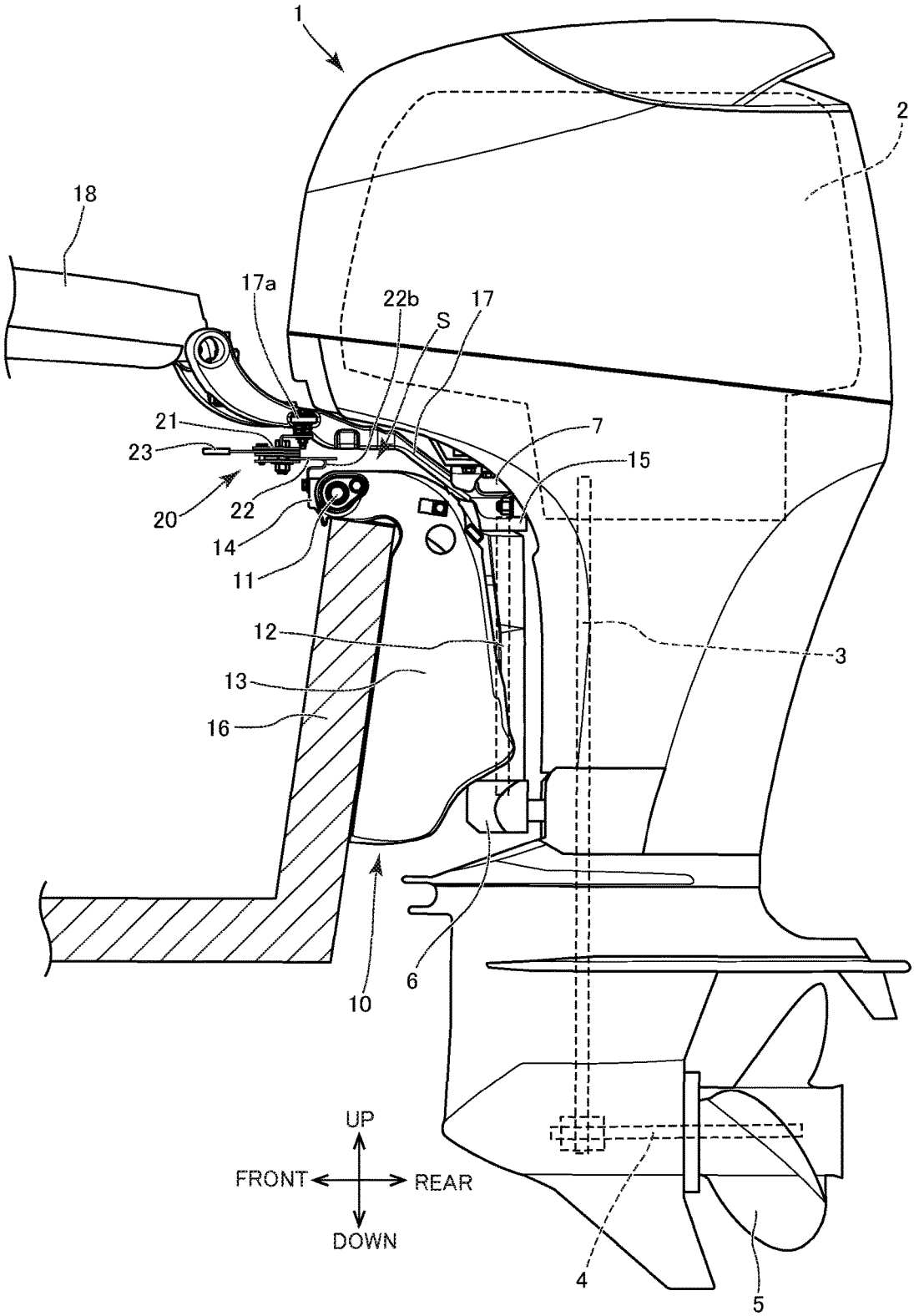
FIG. 1 is a side view of a state where an outboard motor according to a present embodiment is attached to a stern.

Hereinafter, an embodiment of the present invention will be described with reference to the accompanying drawings. As illustrated in FIG. 1, an outboard motor of the present embodiment includes an outboard motor main body 1 and a mounting device 10. In the following explanation and respective drawings, a direction in which a drive shaft 3 described later extends is defined as an up-down direction of the outboard motor, and a direction in which a propeller shaft 4 extends is defined as a front-rear direction of the outboard motor. In the front-rear direction, a front is a hull side, and a rear is an outboard motor side. A direction perpendicular to the up-down direction and the front-rear direction is defined as a width direction (left-right direction) of the outboard motor. In the width direction, a right hand side to the hull side is a right side, and a left hand side is a left side.

As illustrated in FIG. 1, the outboard motor main body 1 transmits rotation from an output shaft of an engine 2 disposed in an engine room at an upper part to the propeller shaft 4 via the drive shaft 3, and rotates a propeller 5 provided at a rear end of the propeller shaft 4. A propulsive force is generated by rotation of the propeller 5.

The outboard motor main body 1 is mounted to a stern part of the hull via the mounting device 10. In a state mounted to the hull by the mounting device 10, a tilt operation to swing the outboard motor main body 1 back and forth around a tilt shaft 11 extending in the width direction, and a steering operation (steering) to swing the outboard motor main body 1 left and right around a steering shaft 12 extending in the up-down direction can be performed. Accordingly, respective directions of up and down, front and rear, and left and right (width) in the outboard motor may not correspond to respective directions of up and down, front and rear, and left and right (width) in the hull.

Figure 2:
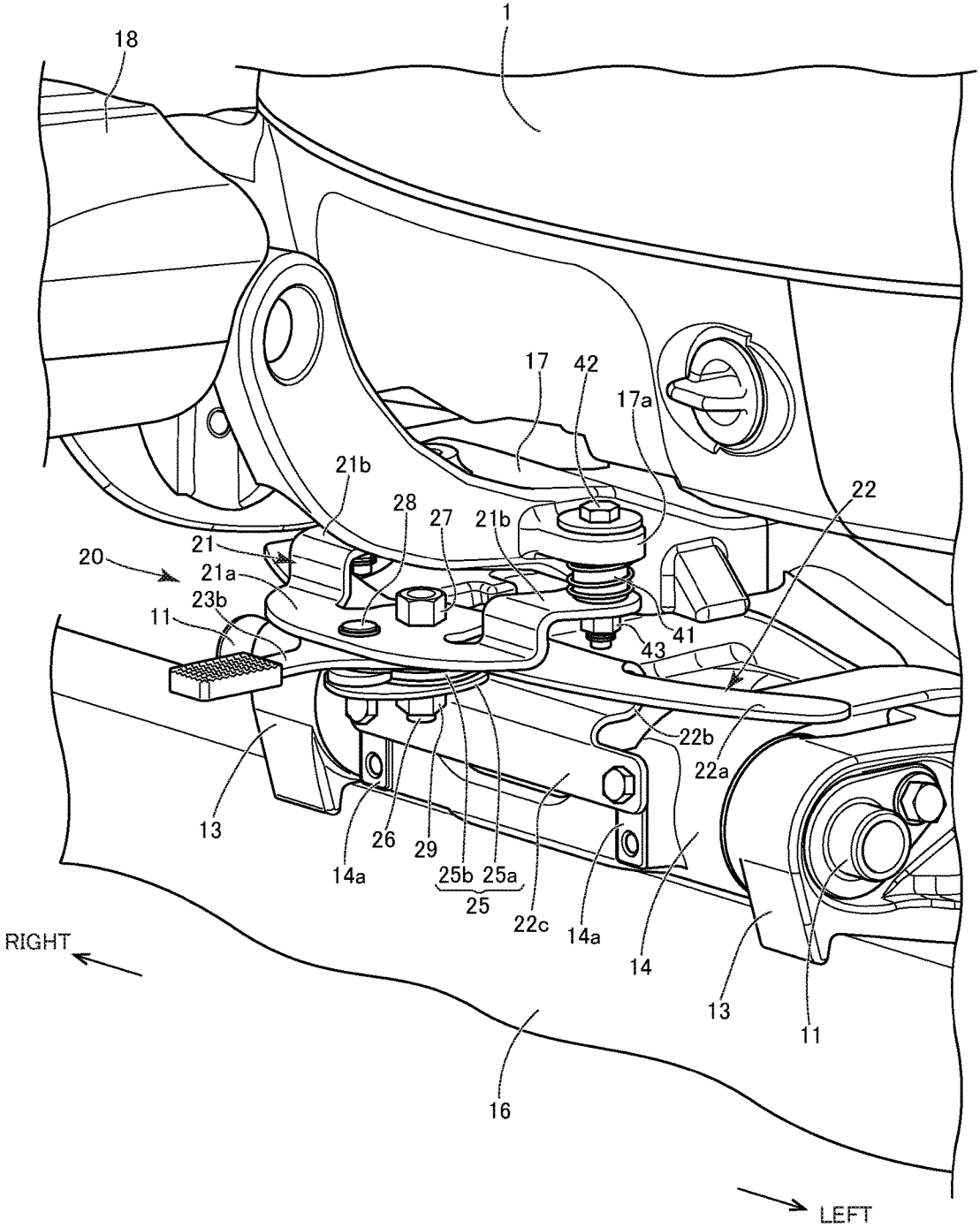
FIG. 2 is a perspective view of a steering load adjustment device configuring a steering apparatus for an outboard motor and a vicinity of the steering load adjustment device.
Figure 3:
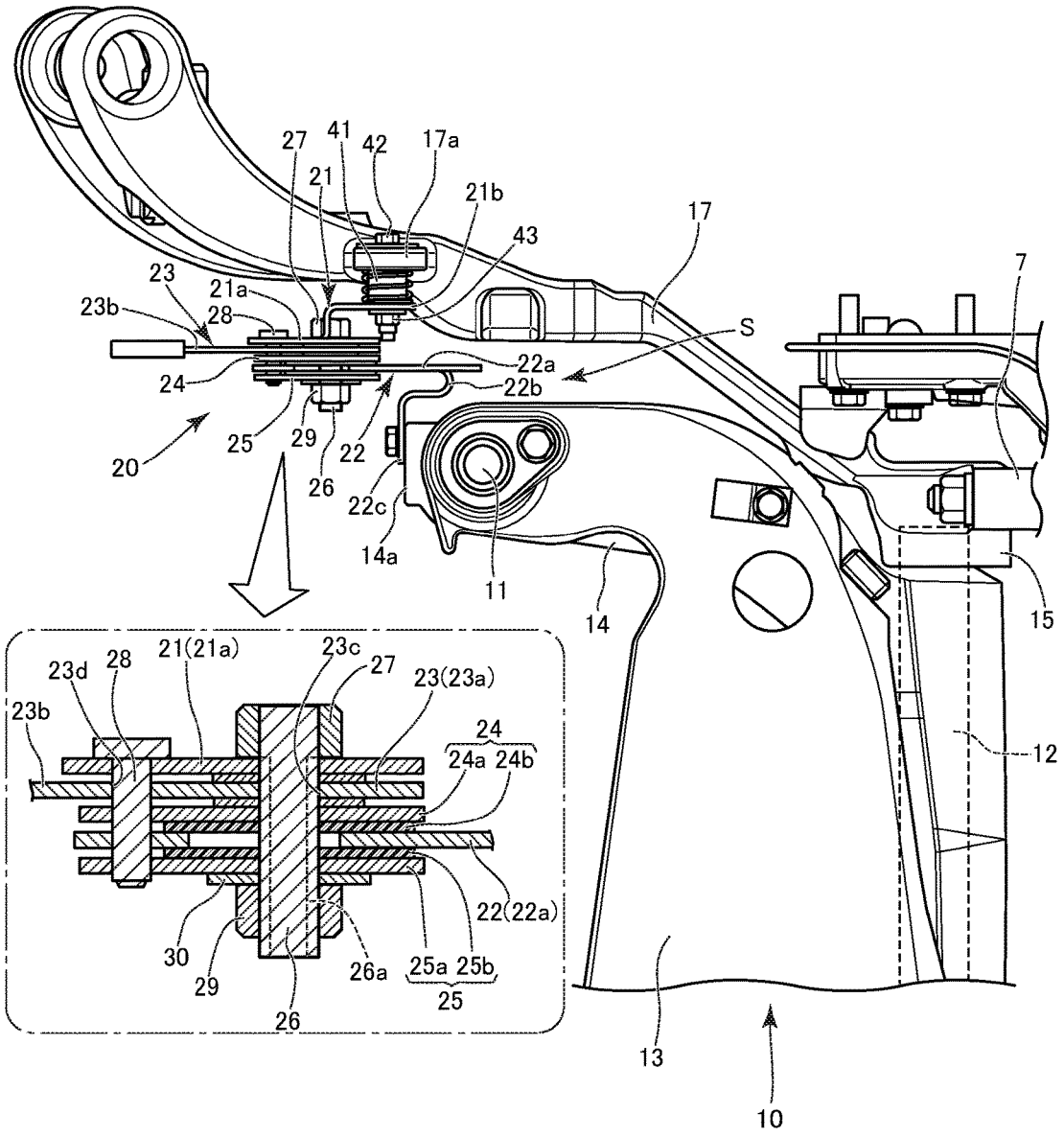
FIG. 3 is a side view of the steering apparatus including the steering load adjustment device.

The mounting device 10 includes a clamp bracket 13 (see FIG. 1 to FIG. 3), a swivel bracket 14 (see FIG. 2) and a steering bracket 15 (see FIG. 1 and FIG. 3). Note that the up-down direction in explanation of the mounting device 10 means an up-down direction in an initial state illustrated in each of the drawings. In other words, according to the tilt operation, angles of parts other than the clamp bracket 13 of the mounting device 10 change to the hull, but respective parts of the mounting device 10 will be described with a state where the drive shaft 3 is oriented to the vertical direction without performing an angle change like this.

The clamp bracket 13 is fixed to a transom 16 provided at the stern of the hull. As illustrated in FIG. 2, the clamp bracket 13 has a pair of left and right support portions that are provided separately in the width direction, and the swivel bracket 14 is disposed between the pair of support portions of the clamp bracket 13. A pair of left and right shaft support holes that are penetrated in the width direction are formed in the pair of support portions of the clamp bracket 13, and a tilt shaft 11 is supported in the shaft support holes (see FIG. 2).

The swivel bracket 14 is supported swingably around the tilt shaft 11. When a drive force is applied to the swivel bracket 14 by a tilt cylinder not illustrated, the swivel bracket 14 swings around the tilt shaft 11. Thereupon, the outboard motor main body 1 that is connected to the swivel bracket 14 via the steering bracket 15 and the steering shaft 12 performs a forward tilting operation (tilt up) to pull the propeller 5 upward, and a backward tilting operation (tilt down) to lower the propeller 5.

A steering shaft hole that is penetrated in the up-down direction is formed in the swivel bracket 14, and the steering shaft 12 is inserted into the steering shaft hole. The steering shaft 12 is supported rotatably around an axial line facing the up-down direction to the steering shaft hole. A lower end of the steering shaft 12 protrudes downward from the steering shaft hole in the swivel bracket 14, and is fixed to the outboard motor main body 1 via a mount portion 6.

An upper end of the steering shaft 12 protrudes upward from the steering shaft hole of the swivel bracket 14, and the steering bracket 15 is attached to a protruded portion of the steering shaft 12. The steering bracket 15 is in a relationship in which the steering bracket 15 swings integrally with the steering shaft 12. The steering bracket 15 is fixed to the outboard motor main body 1 via a mount portion 7.

The steering bracket 15 includes an arm portion 17 that is provided to extend forward from a part that connects to the steering shaft 12. The arm portion 17 has a long and narrow shape passing above the swivel bracket 14. A space S with a predetermined gap in the up-down direction is formed between the swivel bracket 14 and the arm portion 17. In a vicinity of the tilt shaft 11, a top surface of the swivel bracket 14 and an undersurface of the arm portion 17 are substantially parallel, and face each other with the space S therebetween. As illustrated in FIG. 1 to FIG. 3, the arm portion 17 extends forward relative to the swivel bracket 14, and a steering handle 18 which a ship operator operates during steering is connected to a front end portion of the arm portion 17.

An operation of the mounting device 10 configured as above will be described. A tilt operation of the outboard motor main body 1 to cause the outboard motor main body 1 to swing back and forth around the tilt shaft 11 is performed by drive of the tilt cylinder that operates by hydraulic pressure. A steering operation of the outboard motor main body 1 that causes the outboard motor main body 1 to swing left and right around the steering shaft 12 is performed by a manual operation of the steering handle 18. When the ship operator turns the steering handle 18 left and right, the steering bracket 15 and the steering shaft 12 integrally swing, and the outboard motor main body 1 in a fixed relation with the steering bracket 15 and the steering shaft 12 swing left and right. As a result, a traveling direction of the hull changes.

The steering apparatus for the outboard motor includes a steering load adjustment device 20 that adjusts a loaded load of the steering operation, between the swivel bracket 14 and the steering bracket 15. A main part of the steering load adjustment device 20 is located in front of the space S between the top surface of the swivel bracket 14 and the undersurface of the arm portion 17, and a part of the steering load adjustment device 20 (a load absorbing portion 22*b* described later) is located in the space S. The steering load adjustment device 20 has a support plate 21, a friction plate 22, an operation member 23, a pair of pad members 24 and 25, and a shaft bolt 26.

As illustrated in FIG. 2, the support plate 21 has a base portion 21*a*, and a pair of extension portions 21*b* that are in a bifurcated shape from the base portion 21*a* to extend rearward. The arm portion 17 of the steering bracket 15 has a pair of sideward protrusion portions 17*a* (only the sideward protrusion portion 17*a* on the left side is shown in FIG. 1 to FIG. 3). The pair of extension portions 21*b* are respectively mounted to the pair of sideward protrusion portions 17*a* via shaft members 41, bolts 42 and nuts 43, and the support plate 21 swings with the steering bracket 15.

An upper nut 27 and a restriction pin 28 are provided at the base portion 21*a*. The upper nut 27 and the restriction pin 28 are respectively fixed to the support plate 21 by welding or the like, the restriction pin 28 is located close to a front edge of the base portion 21*a*, and the upper nut 27 is located behind the restriction pin 28. The upper nut 27 is located on a top surface of the base portion 21*a*, and has a screw hole inside. In the base portion 21*a*, a through-hole that communicates with the screw hole of the upper nut 27 is formed. The restriction pin 28 has a columnar shape protruding downward from the base portion 21*a*.

As illustrated in FIG. 3, the shaft bolt 26 is inserted into the screw hole of the upper nut 27. The shaft bolt 26 has a screw formed on an outer peripheral surface of a columnar shaft portion, and has a pair of parallel side planes 26*a* extending in an axial direction. No screw is formed on the side planes 26*a*. The shaft bolt 26 is screwed in the screw hole of the upper nut 27.

Figure 4:
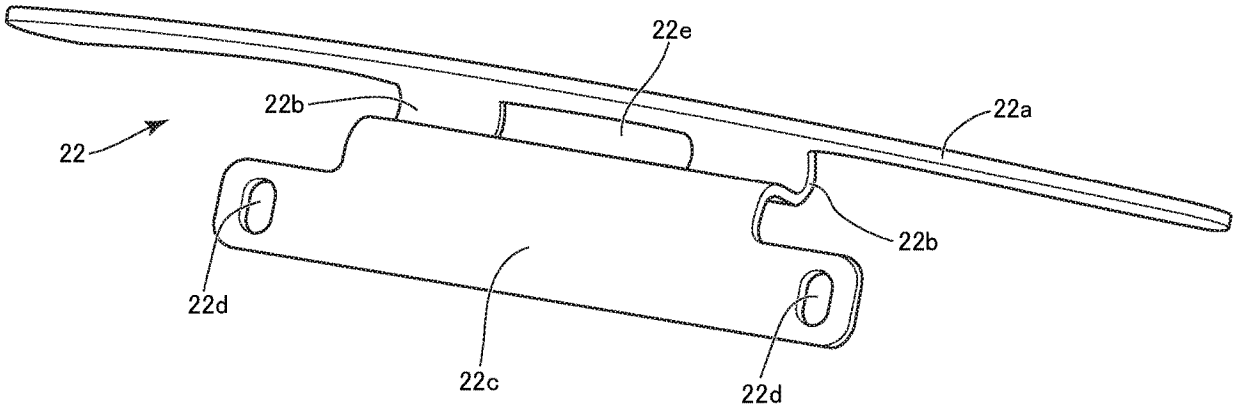
FIG. 4 is a perspective view of a friction plate.
Figure 5:
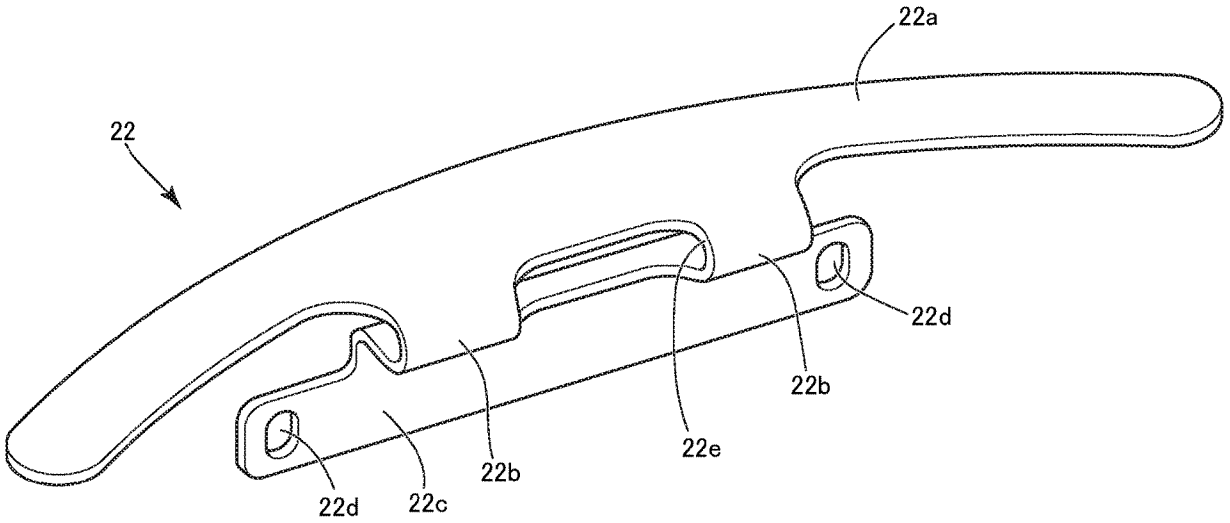
FIG. 5 is a perspective view of the friction plate.

As illustrated in FIG. 2, FIG. 4 and FIG. 5, the friction plate 22 has an arc plate portion 22*a*, a load absorbing portion 22*b*, and a support plate portion 22*c*. The arc plate portion 22*a* is a plate-shaped portion in an arc shape in which a central portion in the width direction protrudes most forward, and curves rearward toward the left and the right from the central portion.

As illustrated in FIG. 3, the load absorbing portion 22*b* is formed into a U-shape to the rear (outboard motor main body 1 side) as viewed from a lateral side of the outboard motor. The load absorbing portion 22*b* protrudes rearward from the central portion in the width direction of the arc plate portion 22*a*, is folded back forward while curving downward above the tilt shaft 11, and is located in the space S between the swivel bracket 14 and the arm portion 17. The load absorbing portion 22*b* (in more detail, an upper side portion and a lower side portion except for a curved tip end of the U-shape) is substantially parallel with an upper portion of the swivel bracket 14 and a lower portion of the arm portion 17 that face each other with the space S therebetween.

The support plate portion 22*c* is formed by bending further downward from the load absorbing portion 22*b*. As illustrated in FIG. 2, a pair of left and right mounting portions 14*a* are provided at a front end portion of the swivel bracket 14, and the support plate portion 22*c* is fixed to the mounting portions 14*a* from a front with bolts. In vicinities of both ends of the support plate portion 22*c*, bolt inserting holes 22*d* are formed. In other words, the friction plate 22 is supported by the swivel bracket 14 with a cantilever structure having the support plate portion 22*c* as a base end.

The friction plate 22 is configured to be easily deformed (spring constant is small) to a load from above in a location of the load absorbing portion 22*b*. In the load absorbing portion 22*b*, a lightening portion 22*e* is formed in a central portion in the width direction, and the spring constant to the load from above is further decreased.

The operation member 23 has a base portion 23*a* that is located on an undersurface side of the base portion 21*a* of the support plate 21, and a gripping portion 23*b* extending forward from the base portion 23*a*. A fitting hole 23*c* is formed in the base portion 23*a*. The fitting hole 23*c* is a hole in a noncircular shape including linear portions corresponding to the side planes 26*a* of the shaft bolt 26, and is fitted to the shaft bolt 26 in a state where rotation is restricted. When the gripping portion 23*b* is swung left and right, the operation member 23 rotates with the shaft bolt 26.

An operation restricting long hole 23*d* (part thereof is illustrated in sectional view in FIG. 3) is further formed in the base portion 23*a* of the operation member 23. The operation restricting long hole 23*d* has an arc shape with the fitting hole 23*c* as a center. The restriction pin 28 is inserted into the operation restricting long hole 23*d*. The restriction pin 28 abuts on an end portion of the operation restricting long hole 23*d*, and thereby a swing range of the operation member 23 is restricted.

The pad member 24 and the pad member 25 are provided in a relationship in which the pad member 24 and the pad member 25 sandwich the arc plate portion 22*a* of the friction plate 22 from above and below. The pad member 24 is configured by a pad holding plate 24*a*, and a friction pad 24*b* provided on an undersurface of the pad holding plate 24*a*, and is located between the base portion 23*a* and the arc plate portion 22*a* (under the base portion 23*a*, over of the arc plate portion 22*a*). The pad member 25 is configured by a pad holding plate 25*a*, and a friction pad 25*b* provided on a top surface of the pad holding plate 25*a*, and is located under the arc plate portion 22*a*. The friction pad 24*b* and the friction pad 25*b* are friction members having a predetermined friction coefficient. The pad member 24 and the pad member 25 swing with the support plate 21 and the steering bracket 15 via the shaft bolt 26, and are further movable up and down along the shaft bolt 26.

The shaft bolt 26 that is screwed into the screw hole of the upper nut 27 and is fitted in the fitting hole 23*c* further extends downward, penetrates through the pad member 24 and the pad member 25 to protrude downward, and is screwed into a screw hole of a lower nut 29. The lower nut 29 abuts on a washer 30 contacting an undersurface of the pad holding plate 25*a* from below.

In the steering load adjustment device 20 of the above configuration, a frictional force (friction resistance) acting between the pad member 24 and the pad member 25, and the friction plate 22 changes according to a degree of fastening of the lower nut 29 to the shaft bolt 26. The steering load of the steering bracket 15 is adjusted by a change in the frictional force of the pad member 24 and the pad member 25 to the friction plate 22 supported by a swivel bracket 14 side.

In an initial state of the steering load adjustment device 20, setting is made so that the friction pad 24*b* of the pad member 24 and the friction pad 25*b* of the pad member 25 contact the arc plate portion 22*a* lightly to apply appropriate resistance feeling, and swing of the steering bracket 15 around the steering shaft 12, that is, steering of the steering handle 18 can be freely performed.

When the gripping portion 23*b* is gripped and the operation member 23 is rotated in a tightening direction, a force to narrow a space between the support plate 21 and the lower nut 29 is applied, the friction pad 24*b* and the friction pad 25*b* come into pressure contact with the arc plate portion 22*a* from both sides of the arc plate portion 22*a*, and rotation resistance between the support plate 21 and the friction plate 22 increases by friction. Thereby, a steering load of the steering bracket 15 to which the support plate 21 is mounted increases. Conversely, when the operation member 23 is rotated in an opposite direction to the tightening direction, the frictional force to the friction plate 22 decreases, and the steering load of the steering bracket 15 decreases. The steering load can be properly changed according to the rotation direction and an operation amount of the operation member 23. Further, when the operation member 23 is rotated to a predetermined position in the tightening direction, a steering angle of the steering bracket 15 can be brought into a fixed state by friction engagement. The arc plate portion 22*a* is in an arc shape along a movement trajectory of the pad member 24 and the pad member 25 when the steering bracket 15 swings around the steering shaft 12, and therefore can arbitrarily adjust the steering load of the steering bracket 15 at a desired steering angle.

Incidentally, a load from an upper side to a lower side may be applied to the steering load adjustment device 20 by the ship operator pressing down the steering handle 18. As illustrated in FIG. 1, the arm portion 17 and the steering handle 18 extend long forward from a position axially supported by the steering shaft 12, and when the steering handle 18 is pressed down from above, a large load easily acts on a part corresponding to the steering load adjustment device 20.

In the steering load adjustment device 20, as a component easy to deform (spring constant is small) to the load from above, the load absorbing portion 22*b* is provided at the friction plate 22. When a load of a predetermined value or more is applied from above, the load absorbing portion 22*b* of the steering load adjustment device 20 deforms and absorbs the load. Since the load absorbing portion 22*b* preferentially deforms, followability of the arc plate portion 22*a* to a positional change in the up-down direction of the pad member 24 and the pad member 25 is improved. As a result, a change in a contact state of the arc plate portion 22*a*, and the pad member 24 and the pad member 25, that is, a change in steering load is suppressed. In this way, by decreasing the spring constant of the friction plate 22, it is possible to prevent a change in steering feeling due to load input from outside that is difference from the operation of the operation member 23, and stabilize the steering load to secure good steering performance.

The load absorbing portion 22*b* protrudes rearward (outboard motor main body 1 side) from the arc plate portion 22*a*, and is in the U-shape located in the space S between the swivel bracket 14 and the arm portion 17 of the steering bracket 15. In more detail, the tip end (rearward end portion of the U-shape) of the load absorbing portion 22*b* is located above the tilt shaft 11. In the space S between the swivel bracket 14 and the steering bracket 15, related components required for steering (link member and cables not illustrated) are provided, and the load absorbing portion 22*b* is disposed with the steering related components by effectively using the space S. Accordingly, it is possible to absorb the load applied to the steering load adjustment device 20 and stabilize the steering load by the configuration excellent in space efficiency.

Easiness of deformation of the load absorbing portion 22*b* can be properly set according to a shape, plate thickness and the like thereof. In the friction plate 22, the spring constant is decreased by forming the lightening portion 22*e* in the central portion of the load absorbing portion 22*b*, and followability of the friction plate 22 at the time of the load being applied from above is improved.

Figure 6:
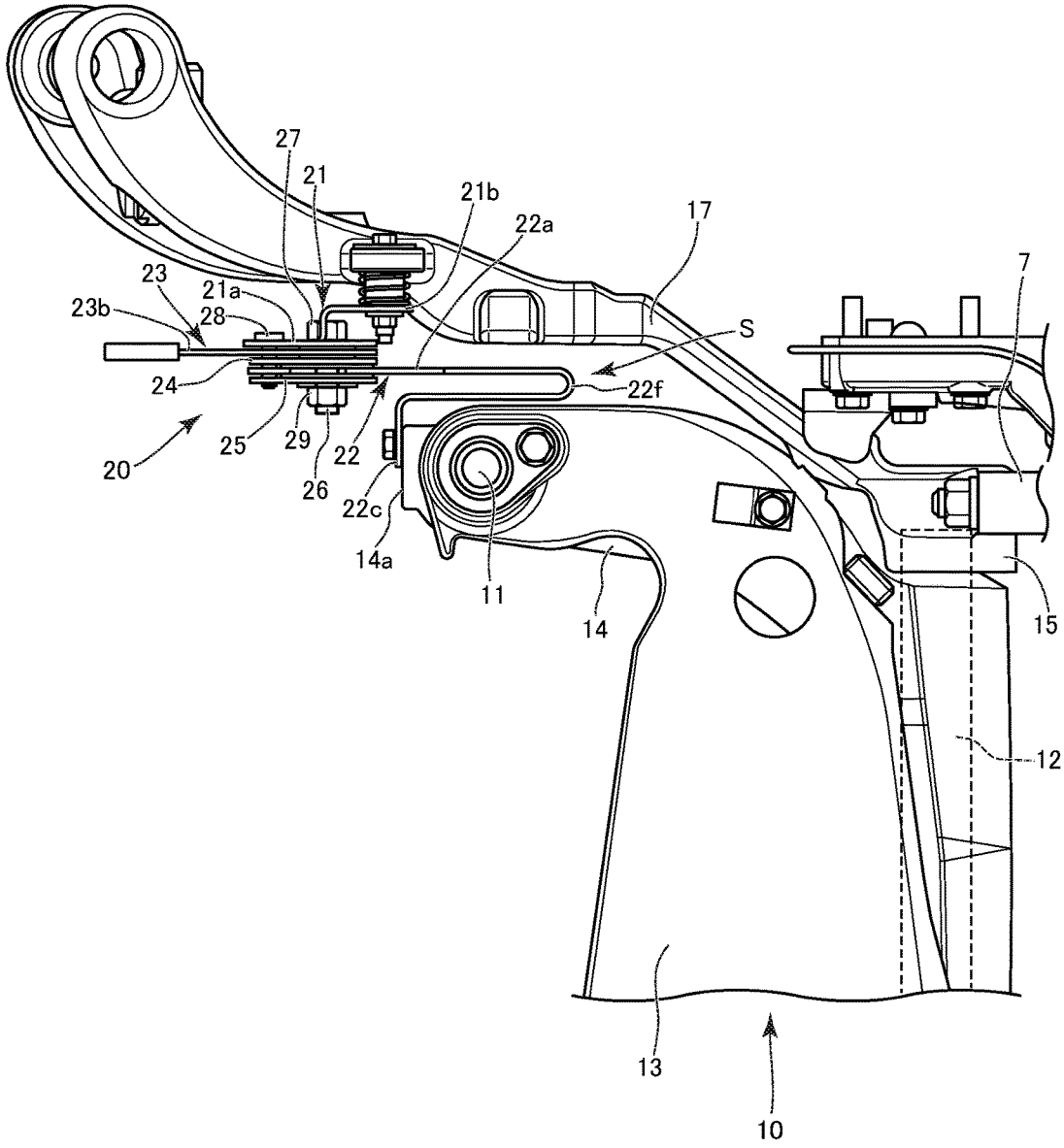
FIG. 6 is a side view of a steering apparatus illustrating a modification of the steering load adjustment device.

FIG. 6 illustrates a modification in which a shape of a load absorbing portion 22*f* provided at a friction plate 22 is made different. The load absorbing portion 22*f* is in a U-shape that extends longer rearward (outboard motor main body 1 side) than the load absorbing portion 22*b* illustrated in FIG. 3, and a tip end (rear end portion of the U-shape) of the load absorbing portion 22*f* is located rearward relative to the tilt shaft 11. By disposing a position of the tip end of the load absorbing portion 22*f* at a position where a distance rearward from an input position of the load from the steering handle 18 is increased, it is possible to cause deformation of the load absorbing portion 22*f* easily. Further, the load absorbing portion 22*f* in the shape extending long rearward is also excellent in use efficiency of a space S between a swivel bracket 14 and an arm portion 17.

As described above, in the steering load adjustment device 20 for an outboard motor of the present embodiment, the load absorbing portions 22*b* and 22*f* are configured by forming the shapes of the friction plates 22 in parts above the swivel brackets 14 into U-shapes that protrude toward the outboard motor side (outboard motor main body 1 side) as viewed from lateral sides of the outboard motors. Thereby, the load absorbing portions 22*b* and 22*f* effectively absorb loads when the loads are applied to the steering brackets 15 (arm portions 17) from above, the steering loads of the outboard motors are stabilized and good steering performance can be secured.

Since the spring constant can be changed by easy shape setting in the friction plate 22, the degree of freedom of setting of the spring constant is high, and improvement in steering feeling is easily realized. Since the friction plate 22 itself includes the load absorbing portion 22*b* or the load absorbing portion 22*f*, and the load absorbing portions 22*b* and 22*f* are shapes easily manufactured by press forming or the like, the load absorbing portions 22*b* and 22*f* can be configured at low cost without increasing the number of components.

Note that the present invention can be carried out by being variously changed without being limited to the above described embodiment. In the above described embodiment, it is possible to properly change the dimensions, shapes and the like illustrated in the accompanying drawings within the range in which the effect of the present invention is exhibited without being limited to the dimensions, shapes and the like illustrated in the accompanying drawings. In addition, it is possible to carry out the present invention by properly changing the present invention within the range without departing from the object of the present invention.

For example, in the above described embodiment, the single large lightening portion 22*e* is formed in the central portion in the width direction of the load absorbing portion 22*b*, and the load absorbing portion 22*b* is formed into a bifurcated shape, but it is also possible to form a plurality of holes that are smaller than the lightening portion 22*e* in the load absorbing portion 22*b*.

Further, in the above described embodiment, thicknesses of the load absorbing portions 22*b* and 22*f* are made same as thicknesses of the arc plate portion 22*a* and the support plate portion 22*c*, but it is also possible to decrease the thicknesses of the load absorbing portions 22*b* and 22*f* than thickness of the other portions of the friction plate 22 to decrease the spring constant.

Further, it is also possible to decrease the spring constant by using a load absorbing portion having a narrower width than widths of the load absorbing portions 22*b* and 22*f* of the above described embodiment.

The steering load adjustment device for an outboard motor of the present invention has an effect of stabilizing the steering load of the outboard motor, and obtaining good steering performance, and is particularly useful for an outboard motor of a structure in which a load from above is easily applied to the steering load adjustment device.

REFERENCE SIGNS LIST

1: outboard motor main body
10: mounting device
11: tilt shaft
12: steering shaft
13: clamp bracket
14: swivel bracket
15: steering bracket
17: arm portion
18: steering handle
20: steering load adjustment device
21: support plate
22: friction plate
22*a*: arc plate portion
22*b*: load absorbing portion (U-shape)
22*e*: lightening portion
22*f*: load absorbing portion (U-shape)
23: operation member
24: pad member
24*b*: friction pad
25: pad member
25*b*: friction pad
26: shaft bolt

What is claimed is:

1. A steering load adjustment device for an outboard motor, the steering load adjustment device being disposed between a steering bracket and a swivel bracket, and adjusting a loaded load to a steering operation following steering of a steering handle, wherein:

adjustment of the loaded load to the steering operation is performed by a change in frictional force of friction pads contacting a friction plate, the friction plate comprises an arc plate portion which is contacted by the friction pads, a support plate portion which is supported by the swivel bracket, and a load absorbing portion provided between the arc plate portion and the support plate portion, the load absorbing portion is disposed above the swivel bracket, and the load absorbing portion has a U-shape protruding in a rearward direction as viewed from a lateral side of the outboard motor.

2. The steering load adjustment device according to claim 1, wherein a tip end on a rear side of the load absorbing portion is positioned above a tilt shaft that swingably supports the swivel bracket.

3. The steering load adjustment device according to claim 1, wherein the friction plate includes a lightening portion that determines a spring constant of the load absorbing portion.

4. The steering load adjustment device according to claim 1, wherein the load absorbing portion is substantially parallel with a lower part of the steering bracket and an upper part of the swivel bracket, as viewed from a lateral side of the outboard motor.

* * * * *